United States Patent [19]

Urch

[11] Patent Number: 4,612,782

[45] Date of Patent: Sep. 23, 1986

[54] TWIN RESERVOIR HEAT TRANSFER CIRCUIT

[76] Inventor: John F. Urch, 35 Tintern Road, Ashfield, New South Wales 2131, Australia

[21] Appl. No.: 742,730

[22] Filed: Jun. 7, 1985

[51] Int. Cl.[4] ..... F25B 1/06

[52] U.S. Cl. ..... 62/500; 62/116

[58] Field of Search ..... 62/500, 116

[56] References Cited

U.S. PATENT DOCUMENTS

| | | | |
|---|---|---|---|
| 3,199,310 | 8/1965 | Schlichtig | 62/500 |
| 3,242,679 | 3/1966 | Puckett et al. | 62/116 |
| 3,500,897 | 3/1970 | Von Cube | 62/500 |
| 3,817,055 | 6/1974 | Hosokawa | 62/500 |
| 3,922,877 | 12/1975 | Ophir et al. | 62/500 |
| 4,192,148 | 3/1980 | Von Kreudenstein | 62/500 |
| 4,250,715 | 2/1981 | Ratliff | 62/500 |
| 4,301,662 | 11/1981 | Whitnah | 62/500 |
| 4,321,801 | 3/1982 | Collard, Jr. | 62/500 |
| 4,374,467 | 2/1983 | Briley | 62/500 |

FOREIGN PATENT DOCUMENTS 3044677 7/1982 Fed. Rep. of Germany .

*Primary Examiner*—Ronald C. Capossela

*Attorney, Agent, or Firm*—Dellett, Smith-Hill and Bedell

[57] ABSTRACT

A refrigeration or air-conditioner circuit has an ejector through which refrigerant is driven from a heated supply reservoir to an unheated collecting reservoir. The ejector sucks refrigerant from a branch circuit containing an expansion valve and an evaporative heat-exchanger providing cooling. Valving interchanges the functions of the two reservoirs when the refrigerant supply reservoir is empty so that operation of the circuit is uninterrupted.

11 Claims, 9 Drawing Figures

TWIN RESERVOIR HEAT TRANSFER CIRCUIT

FIELD OF THE INVENTION

This invention relates to heat-transfer circuitry and is more specifically concerned with one in which a refrigerant working fluid flows around a closed circuit to transfer heat between two stations in the circuit.

STATE OF THE ART

Conventional heat-transfer circuitry usually relies on a compressor to pump the working fluid around the circuit. The working fluid changes between its vapour phase and its liquid phase, in accordance with the prevailing temperature and pressure in different parts of the circuit, and whether latent heat is liberated or absorbed.

The motor-driven compressor represents a significant part of the capital cost. For example if the circuitry is being used to provide an air-conditioning unit for a car, the compressor may be one-third of the total cost of the unit.

The motor-driven compressor also has a significant effect on the operating efficiency of the circuitry as it represents a continuous drain of power. In the case of a motor car, the consumption of power to operate an air-conditioning unit can produce a marked increase in the rate of fuel consumption of the car.

W. Martynowski has proposed a form of heat-transfer circuitry in which the running costs are reduced by utilizing waste heat as a source of energy to help operate the circuitry (see KHOLODILNAYA TECNIKA (Russian) Vol. 30, No. 1, January–March 1953 edition, page 60). The working fluid is FREON (a commerically available refrigerant) which is boiled by waste heat obtained elsewhere, and the vapour produced is driven under pressure around a primary circuit comprising an ejector and a condenser cooled by cooling water. The FREON vapour is condensed to its liquid phase in the condenser and part of it is returned by a pump to the boiler while the remainder is fed into a branch circuit extending to a suction inlet of the ejector. The branch circuit contains an expansion valve and an evaporator so that the liquid working fluid expanded adiabatically through the valve extracts heat from the vicinity of the evaporator before rejoining the primary circuit at the ejector.

The Martynowsky proposal is theoretically interesting but has commercial disadvantages. For example, a mechanical feed pump is necessary to return liquified working fluid to the boiler and it has to be powerful enough to overcome the back pressure produced in the boiler by the vapourisation of the working medium in it. The energy required to operate the pump is significant as also are its running costs. Finally FREON has a tendency to produce cavitation effects in a conventionally-designed compressor with a consequent loss in pumping efficiency.

OBJECT OF THE INVENTION

An object of this invention is to provide heat-transfer circuitry which does not require a compressor to operate it.

THE INVENTION

In accordance with the present invention there is provided heat-transfer circuitry having a primary flow circuit containing ejector means through which vapourised working fluid, heated in first reservoir means, is discharged to create low pressure at a suction inlet of the ejector means, means for collecting and cooling working fluid after it has passed through the ejector means, and a branch circuit connected at one end to the suction inlet and containing a heat-exchanger and an expansion valve arranged to expand liquified working fluid from the primary circuit adiabatically into the heat-exchanger to cool it; the improvement in such circuitry comprising the provision of a second reservoir means in which the bulk of the working fluid from the ejector means is collected in its liquid phase, valve means operable to substitute the second reservoir, when full, for the first reservoir means, when empty, and heating means associated with respective reservoirs and individually operable to boil the working fluid in whichever of the reservoir means is supplying working fluid to the ejector means.

The working fluid may be provided to the ejector means in liquified form or in vapour form, depending on the design of the ejector means and the temperature and pressures of the working fluid in different parts of the circuitry.

The circuitry of the invention is entirely heat-operated, and as the heat used to boil the working fluid in the reservoir means may be solely waste heat, a consequential reduction in running costs is readily obtainable. The absence of a compressor also reduces the capital costs and the wear inevitably present with mechanically moving parts.

The invention may be used in a static installation, such as commercial or a domestic air-conditioning, refrigeration or chilling installation. It may also be used in a mobile installation such as a motor vehicle when it can operate off the engine waste heat.

PREFERRED FEATURES OF THE INVENTION

Preferably the circuitry includes change-over switches enabling the functions of two heat-exhangers remotely situated from one another, to be reversed. Each heat exchanger is thus selectively able to provide a source of heating or a source of cooling. When one of the heat-exchangers is acting as a cooler the other is acting as a heater. By interchanging the functions of the heat-exchangers to suit the climatic conditions, the circuitry can provide an air-conditioning unit.

INTRODUCTION TO THE DRAWINGS

The invention will now be described in more detail, by way of examples, with reference to the accompanying diagrammatic and greatly simplified circuit drawings, in which:

In The Drawings

DESCRIPTION OF PREFERRED EMBODIMENT

Figure 1:
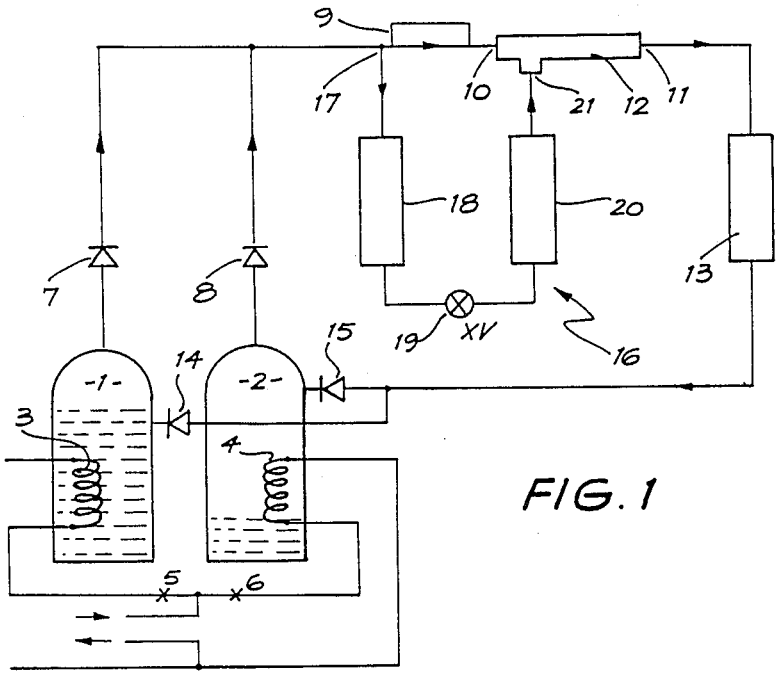
FIG. 1 shows a first form of heat-transfer circuitry using a gas-operated ejector.

The circuitry shown in FIG. 1 comprises two tanks 1 and 2 providing reservoirs for a liquified working fluid such as that known commercially as "FREON", or one of the other commercial refrigerants known commercially in Australia as "R-11", "R-12", "R-500", "R-501" or "R-502". By suitably adapting the pressure and temperature parameters of use, the circuitry can be used with most refrigerants which undergo changes in phase while travelling around a closed circuit. The tank 1 is shown in FIG. 1 three-quarters filled with liquified working fluid and the tank 2 is shown only a quarter filled.

The tanks 1 and 2 respectively contain heating means provided by tube coils 3 and 4, respectively, which have associated valves 5 and 6 controllable to allow a heating medium such as hot water to engine gas, to flow selectively through the coils.

The tanks 1 and 2 have top outlets controlled by valves 7 and 8 which connect the upper ends of the tanks via an optional superheater 9, to a vapour drive inlet 10 of an ejector 12. The ejector 12 has a vapour outlet 11 connected through a condenser 13 to non-return valves 14,15 for returning liquified working fluid to whichever of the tanks 1,2 is at the lower pressure. The part of the circuitry thus far described will be referred to hereafter as "the primary circuit".

The circuitry is provided with a branch circuit 16 connected at its inlet end 17 to receive part of the vapourised working fluid from the tanks 1,2. If the optional superheater 9 is used, the inlet end 17 is disposed upstream of the superheater 9.

The branch circuit 16 contains a condenser 18 to liquify the working fluid, an expansion valve 19 through which the liquified working fluid is adiabatically expanded into an evaporator 20 which is cooled thereby. The outlet end of the branch circuit 16 is connected to a suction inlet 21 of the ejector 12.

OPERATION OF THE PREFERRED EMBODIMENT

When the circuitry is in use, the working fluid flows in the direction indicated by the arrows. It is assumed in the figure that heat is being applied to the tank 1. Vapourised working fluid is fed under pressure from the tank 1 through the valve 7 and the superheater 9, to the drive inlet of the ejector 12 to create suction at the inlet 21. The hot vapourised working fluid flows from the ejector outlet 11 to the condenser 13 which liquifies it. It then flows through the non-return valve 15 to the cooled tank 2. Thus, as the working fluid is driven from the tank 1, it accumulates in the tank 2.

Part of the vapourised working fluid, determined by the setting of the expansion valve 19, flows through the branch circuit 16 and extracts heat from the evaporator 20 which may form part of a refrigeration or chilling installation.

It will be noticed that the circuitry described does not require a mechanical compressor or pump to make it operate. The disadvantages mentioned above and associated with such equipment are therefore avoided. The circuitry can also be operated entirely from what would otherwise be waste heat produced by an internal combustion engine. The operation of the circuitry is relatively insensitive to vibration and tilt, unlike the conventional absorption refrigerator, and the control of the temperature of the evaporator in the branch circuit is relatively unaffected by changes in the flow rate of working fluid through the primary circuit.

When the tank 1 is almost empty, the tank 2 is almost full. The heater 3 is then turned off and the heater 4 turned on so that the pressure and temperature conditions in the two tanks are reversed. The tank 2 therupon operates to deliver working fluid to the ejector 12 and the liquified working fluid from the primary circuit is collected in the tank 1. The above-described periodic reversal of the functions of the two tanks continues to take place as long as the circuitry is operating without any noticeable fluctuation in the cooling effect of the evaporator occurring.

SECOND EMBODIMENT

Figure 2:
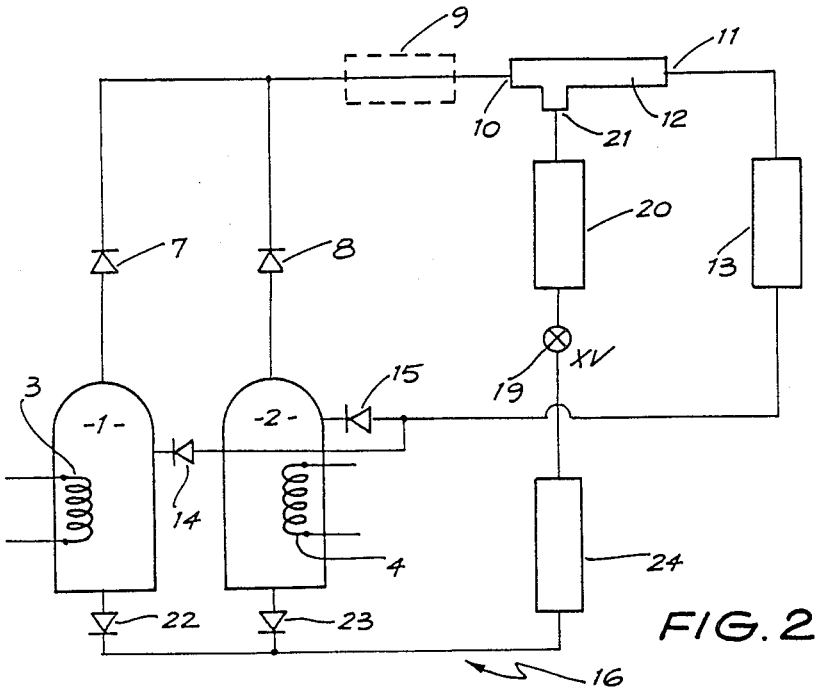
FIG. 2 shows a second form of heat-transfer circuitry having an enhanced pressure drop produced across a branch circuit.

In the circuitry of FIG. 2, the primary circuit is the same as that shown in FIG. 1. The same reference numerals are used to denote corresponding parts which will not therefore be again described.

The distinction between FIGS. 1 and 2 lies in the branch circuit 16. In FIG. 2 this is connected to receive liquified working fluid from whichever of the tanks is heated, by way of the non-return valves 22, 23. The tanks are selectively heated by activation of respective heaters 3,4 located in the upper portions of the tanks so that liquified working fluid entering the branch circuit 16 is not overheated and is at the pressure prevailing in the heated tank.

The liquified working fluid flows from the open non-return valve 22,23 to a cooler 24 which supplies it to an expansion valve 19 discharging into the evaporator 20 as in FIG. 1.

The advantage of the circuitry of FIG. 2 over that shown in FIG. 1, is that the pressure difference between the ends of the branch circuit is greater and thus its cooling effectiveness is increased. The use of the superheater 9 is again optional.

THIRD EMBODIMENT

Figure 3:
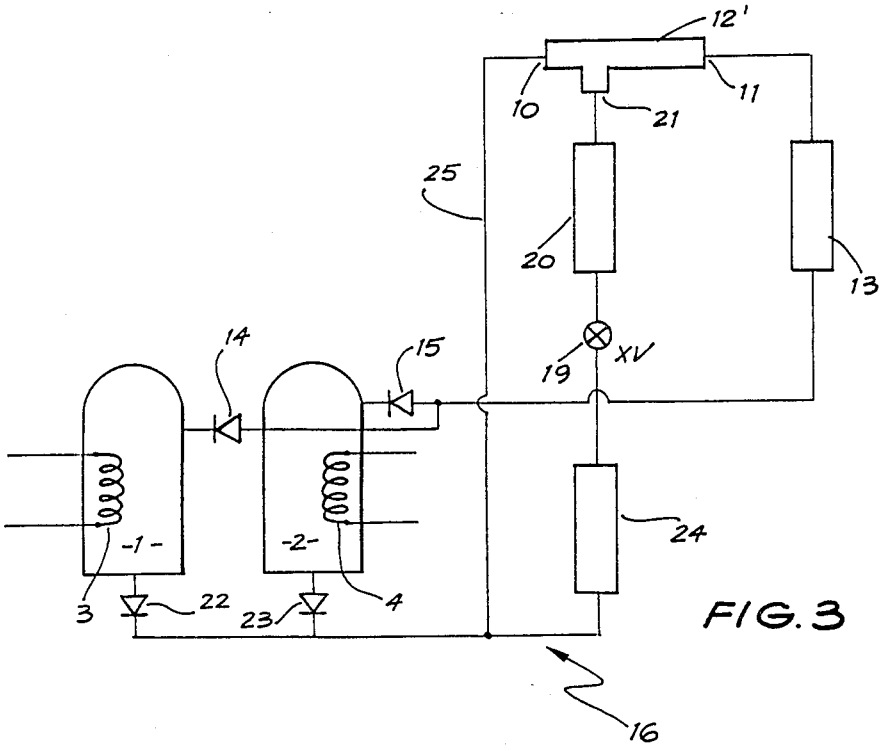
FIG. 3 shows a third form of heat transfer circuitry using a liquid-operated ejector.

The circuitry of FIG. 3 is based on that of FIG. 2 and corresponding parts are similarly referenced and will not be again described.

The distinction between the circuitry of FIGS. 2 and 3 is that, in FIG. 3, the ejector 12′ receives liquified working fluid from the heated tanks 1,2 rather than vapourised working fluid. Liquid operated ejectors have, in certain circumstances, operating advantages over gas-operated ejectors.

In FIG. 3 the liquified working fluid used to operate the ejector 12′ is received under pressure at its drive inlet 10 by way of a line 25 connected to the outlets of the non-return valves 22,23.

FOURTH EMBODIMENT

Figure 4:
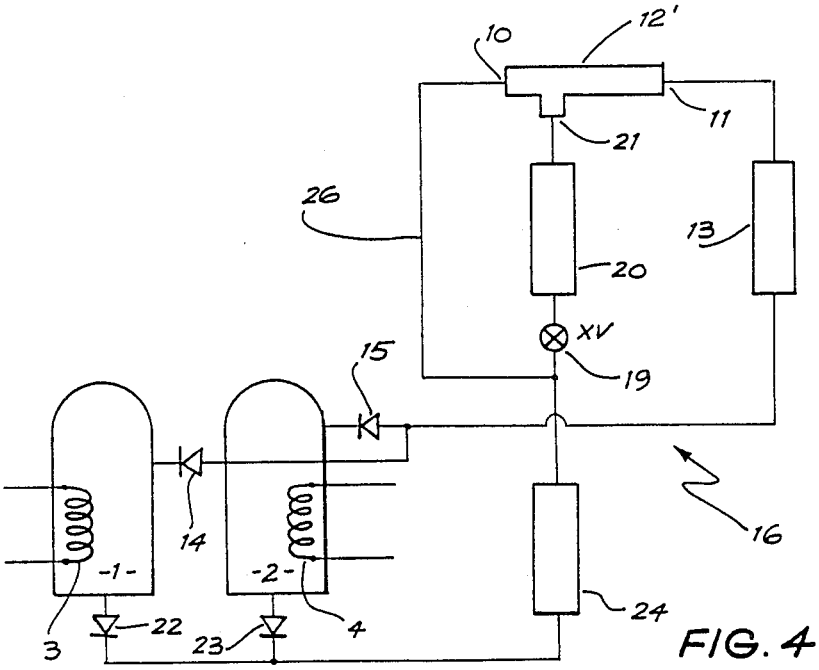
FIG. 4 shows a modification of the circuitry of FIG. 3.

FIG. 4 shows a modification of FIG. 3. Corresponding parts have the same reference numerals and will not be again described. In FIG. 4 the ejector 12′ receives liquified working fluid at its drive inlet 10, from a line 26 which is connected at its other end to the junction of the cooler 24 and the expansion valve 19. The temperature of the liquified working fluid entering the ejector 12' is thus lower than is possible with the circuitry of FIG. 3.

FOURTH EMBODIMENT

Figure 5:
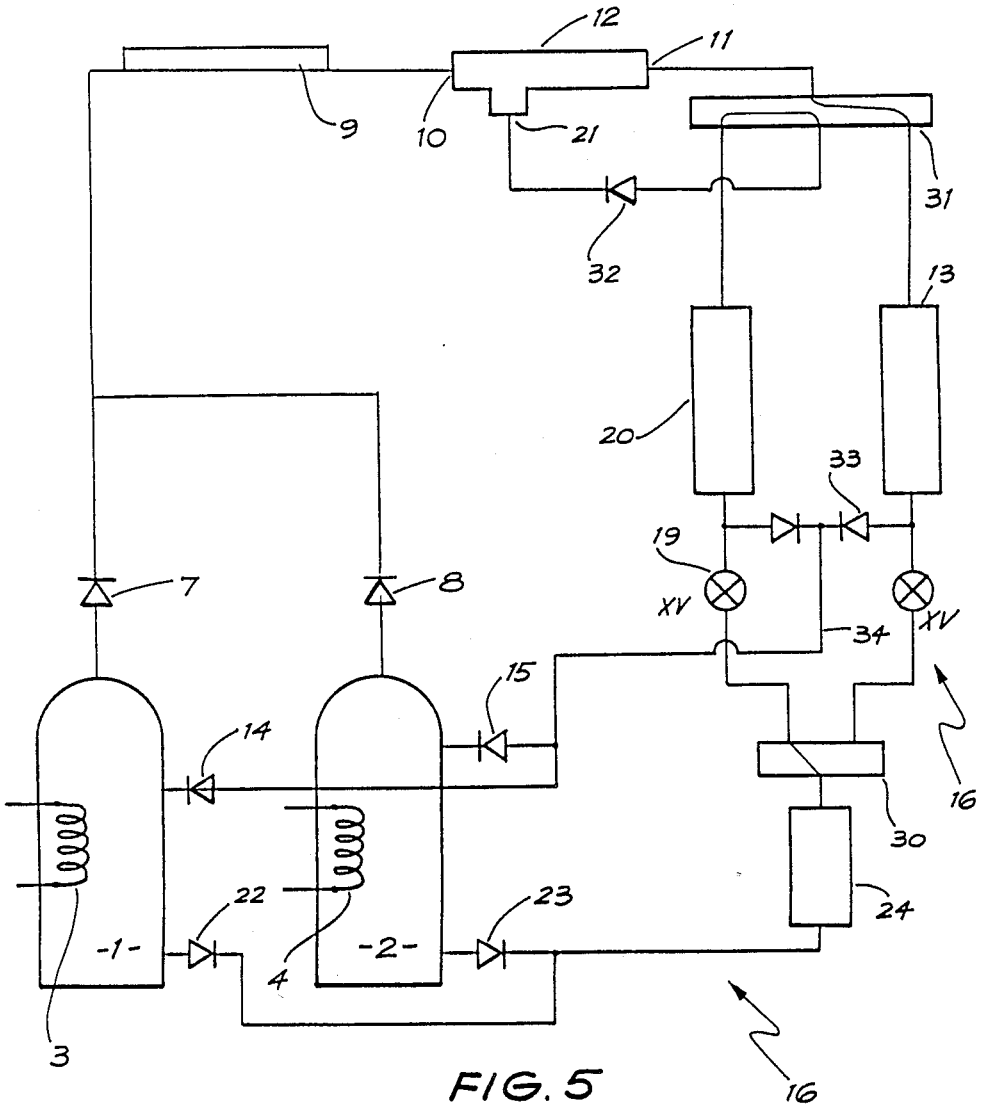
FIG. 5 shows a fourth form of heat-exchange circuitry in a space-cooling mode.

The circuitry shown in FIG. 5 is based on the circuitry shown in FIG. 2 and once again the same reference numerals have been used to denote corresponding parts so that unnecessary description is avoided. The distinction between the circuitries of FIGS. 2 and 5 is that, in the latter circuitry, reversing valves are provided to enable the branch circuit to operate either in a space heating or cooling mode. The circuitry is thus well suited for use in an air-conditioner for a static installation such as a building, or a mobile installation such as a motor car.

FIG. 5 shows the circuitry in the space-cooling mode in which cooled liquified working fluid is drawn from the cooler 24 through the reversing valve 30 to the expansion valve 19 which discharges it into the evaporator 20 to produce the desired cooling effect. The evaporator is connected by the second reversing valve 31 to the suction inlet 21 of the ejector 12, by way of a non-return valve 32.

The ejector is driven by vapourised working fluid to create suction at the inlet 21, and vapourised working fluid is discharged from its outlet 11 and directed, via the reversing valve 31, to the condenser 13. The liquified working fluid flowing from the condenser 13 passes through a non-return valve 33 to a line 34 which discharges it via one of the non-return valves 14,15 to whichever of the tanks 1,2 is acting as a collector.

Figure 6:
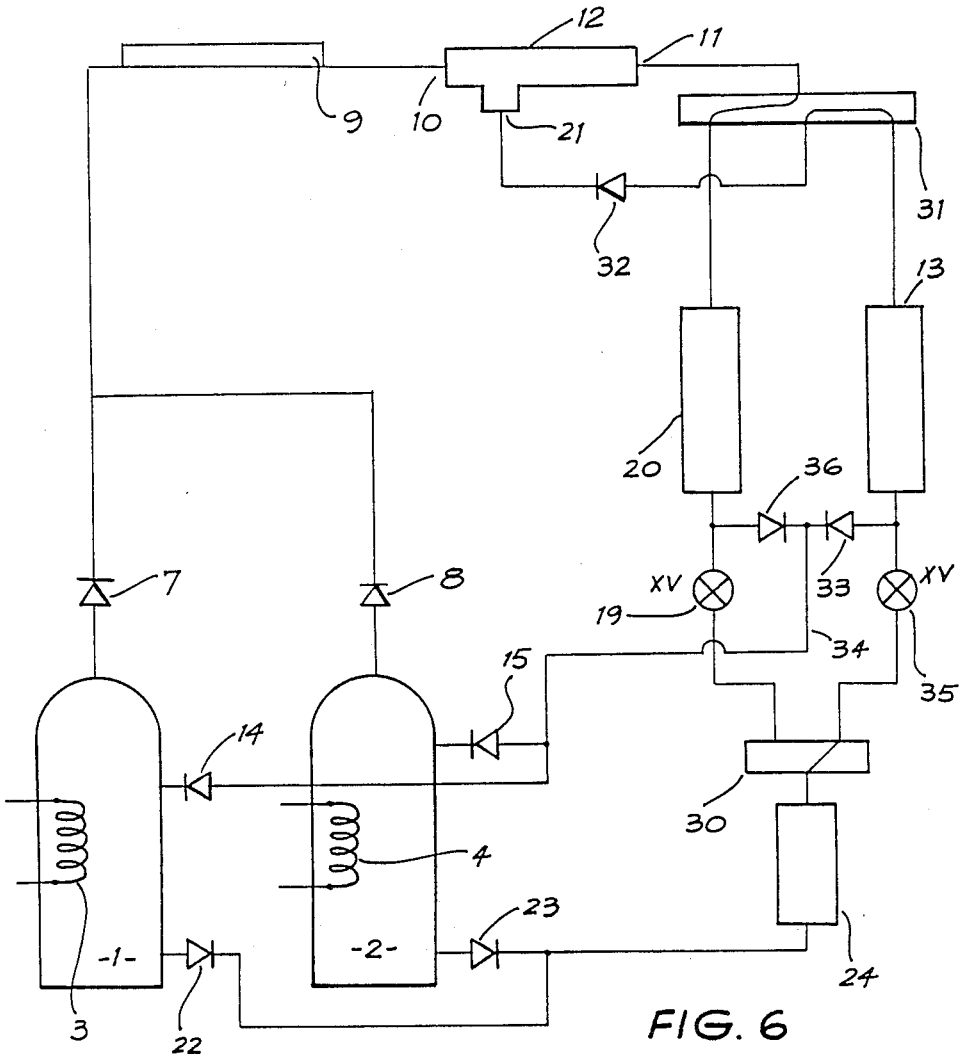
FIG. 6 shows the circuitry of FIG. 5 in its space-heating mode.

The circuitry of FIG. 5 is changed to its space-heating mode by moving the two valves 30,31 to the positions shown in FIG. 6. Liquified working fluid from the cooler 24 is then directed by the valve 30 to an expansion valve 35 which discharges it adiabatically into the condenser 13. The condenser 13 is basically a heat-exchanger and drws heat from its surroundings to provide the latent heat of evaporation of the working fluid. The vapourised working fluid from the condenser 13 passes via the valve 31 and the non-return valve 32 to the suction inlet of the ejector where it mixes with the working fluid in the primary circuit and is discharged with it from the ejector outlet 11. The hot vapourised working fluid from the ejector 12 is directed by the valve 31 into the evaporator heat-exchanger 20. The working fluid condenses in the heat-exchanger 20 to heat its surroundings with its latent heat of condensation. It then flows via a non-return valve 36 to the line 34 and is returned through it to the tanks 1,2.

VARIATION OF FOURTH EMBODIMENT

Figure 7:
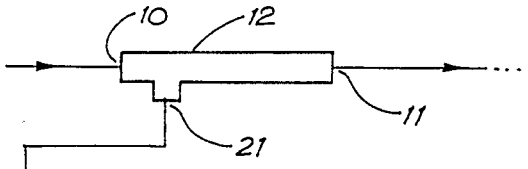
FIG. 7 shows a form of branch circuit usable in the heat-transfer circuitry to improve its efficiency.

FIG. 7 shows a way of improving the efficiency of the branch circuit shown in FIG. 5. Liquified working fluid is drawn into the branch circuit by way of the cooler 24 and flows through a heat-exchanger 40 before discharging through the expansion valve 19 into the evaporator 20. The cooled vapour leaving the evaporator 20 flows back to the heat-exchanger 40 and is drawn off through the ejector 21. The cooled vapour in the heat-exchanger 40 cools the liquified working fluid supplying the expansion valve 40 to improve the cooling effect prodiced by the evaporator 20.

FIFTH EMBODIMENT

Figure 8:
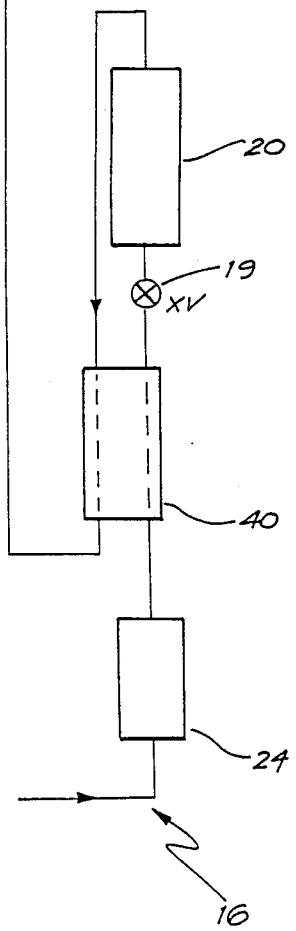
FIG. 8 shows a further form of heat transfer circuitry in its space-heating mode.
Figure 8:
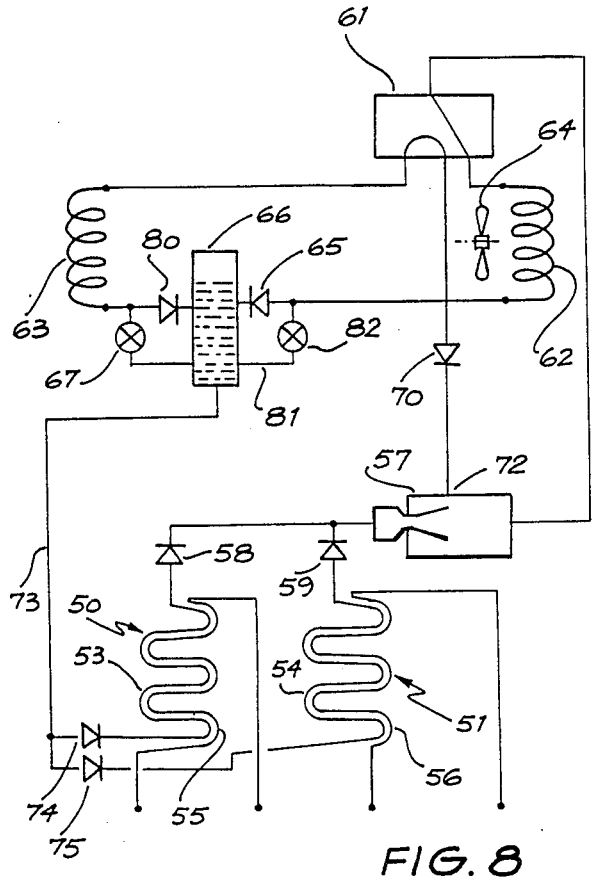

In the circuitry of FIG. 8 the tanks 1,2 of earlier figures which provide reservoirs of working fluid to be heated, are replaced by concentrically arranged tube assemblies arranged in coils 50,51, each being of extended length. Each assembly provides two coaxially arranged flow paths in good heat-transfer relationship. The inner paths, provided by the inner tubes 53,54 serve as reservoirs for liquified working fluid, and the outer paths, provided by the outer tubes 55,56 have circulated through them either a hot fluid if the associated tube is to provide heated working fluid to an ejector 57, or a cold fluid if the associated inner tube is to provide a collector for liquified working fluid from the primary circuit.

As with previous embodiments, the reservoirs are substituted for one another when the heated reservoir is almost empty and the cooled reservoir is almost full.

The upper ends of the inner tubes 53,54 are connected through respective non-return valves 58,59 to a drive inlet 60 of the ejector. Vapourised working fluid is fed from the ejector to a reversing valve 61 supplying, in accordance with its operating position, one of tweo heat-exchangers 62,63. The two operating positions of the valve 61 are respectively shown in FIGS. 8 and 9. In FIG. 8, the vapourised working fluid passes from the valve 61 to the heat-exchanger 62 which as providing heat used to warm a stream of air supplied tby a fan 64.

The working fluid condenses in the heat-exchanger 62 and is fed through a non-return valve 65 to a cooling tank 66. This is kept at a low pressure by part of its contents being drawn off through an expansion valve 67 which discharges it adiabatically into the second heat-exchanger 63. This acts as an evaporator and is connected via the valve 61 and the non-return valve 70 to a suction inlet 72 of the ejector 57.

Liquified and cooled working fluid from the cooling tank 66 descends through a line 73 to a pair of non-return valves 74,75 connected respectively to the lower ends of the tubes 53,54.

The circuitry described operates to deliver heat to the fanblown air continuously, despite the periodic substitution of the full reservoir tube ofr the empty one. The change in operation of the tubes is effected by reversing the hot and cold liquid supply connections to the tubes 55,56.

Figure 9:
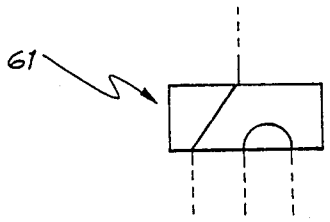
FIG. 9 shows parts of the circuitry of FIG. 8 in the states they assume when the circuitry is operating in its space-cooling mode.

If the circuitry is to function in its cooling mode, the valve 61 is moved to the position shown in FIG. 9. Vapourised working fluid from the ejector 57 then passes to the heat exchanger 63 where it is cooled and liquified and passes through a non-return valve 80 to the cooling tank 66. Most of the working fluid returns via the line 73 to whichever of the reservoir tubes 53,54 is acting as a collector. The remainder of the liquified working fluid is drawn off the lower end of the cooling tank 66 through the line 81 and discharges adiabatically through an expansion valve 82 into the heat exchanger 62. The air driven by the fan 64 is then cooled by passage past the heat-exchanger 62. The vapourised working fluid flows through the reversing valve 61, now in the position shown in FIG. 9, to the suction inlet 72 of the ejector 57.

It will be noted that in all of the circuitry described the use of a compressor or mechanical pump in the working fluid flow path is avoided by the use of two reservoirs which interchange functions periodically. This is important as some working fluids, such as "FREON" are to sensitive to pressure changes that the variations in pressure which occur around the impeller of a compressor or pump, can cause localised vapourisation of the working fluid with consequent cavitation and a loss of pumping pressure and efficiency. The circuitry of the invention is also well adapted to use in locations where electrical power is not available and there is a plentiful source of unused heat which may be solar or waste heat. Naturally the circuitry is also usable in conventional domestic refrigerators when the heat can be provided electrically, as there is minimal noise when the circuitry is operating.

Although the reservoirs are described as being heated by coiled tubular heaters, heat may instead be applied to the outside walls of the tanks 1,2 directly by placing them alternately against a source of heat.

I claim:

1. Heat transfer means comprising circuitry defining a closed flow path for working fluid; a primary circuit forming part of said path and having two ends at one of which the working fluid is at a high pressure and at the other of which the working fluid is at a low pressure; a fluid supply reservoir and a fluid collection reservoir disposed respectively at said two ends; ejector means in said primary circuit; a drive fluid inlet, an exhaust outlet and a suction inlet provided on said ejector means; a branch circuit bridging a section of the primary circuit; an outlet end of said branch circuit connected to the suction inlet of the ejector means and an inlet end of the branch circuit connected to receive working fluid from the high pressure end of the primary circuit; an expansion valve and an evaporative heat-exchanger connected in series in said branch circuit, the heat-exchanger being connected for flow therethrough of working fluid from the expansion valve to the suction inlet; means for cooling the fluid exhausting from the outlet of the ejector means and returning it in liquified form to the fluid collection reservoir; heating means associated with the reservoirs and operable to raise the temperature of liquified working fluid in the fluid supply reservoir; and, valve means to interchange, periodically, the functions of the two reservoirs when the fluid supply reservoir is full and the fluid collection reservoir is empty.

2. Heat transfer means as set forth in claim 1, forming part of air-conditioning means and having reversing valve means controlling the flow of fluid through the branch circuit to provide, selectively, heating and cooling of air passing the heat-exchanger in accordance with the setting of the reversing valve means.

3. Heat transfer means as set forth in claim 2, including a cooling tank in which working fluid is cooled before entering the fluid collection reservoir.

4. Heat transfer means comprising circuitry defining a closed flow path for working fluid at one of which the working fluid is at a high pressure and at the other of which the working fluid is at a low pressure; a primary circuit forming part of said path and having two ends; a fluid supply reservoir and a fluid collection reservoir disposed respectively at said two ends; ejector means in said primary circuit; a drive fluid inlet, an exhaust outlet and a suction inlet provided on said ejector means; a first vapourised fluid flow path extending from the upper endportion of the fluid supply reservoir to the drive fluid inlet of the ejector means; a second vapourised fluid flow path extending from the exhaust outlet of the ejector means to means for cooling and liquifying and storing the fluid from the ejector means, in the collection reservoir; a branch circuit bridging a section of the primary circuit; an outlet end of said branch circuit connected to the suction inlet of the ejector means and an inlet end of the branch circuit connected to receive liquified working fluid from the fluid supply reservoir provided at one end of the primary circuit; an expansion valve in said branch circuit and an evaporative heat-exchanger connected for flow of working fluid therethrough from the expansion valve towards the suction inlet; heating means associated with the reservoirs and operable to raise the temperature of fluid in the fluid supply reservoir; and, valve means for interchanging, periodically, the functions of the two reservoirs when the fluid supply reservoir is full and the fluid collection reservoir is empty.

5. Heat transfer means as set forth in claim 4, in which each of said reservoirs comprises two concentrically-arranged spaced tubes of extended length providing inner and outer upwardly-extending flow paths in heat-exchange relationship, the inner flow path being connected for flow of working fluid therethrough and the outer path being connected for selective flow therethrough of hot and cold media to provide, respectively, heating and cooling of the reservoirs in accordance with whether they are operating as supply or collection reservoirs.

6. Heat transfer means as set forth in claim 5, including a superheater arranged in the primary circuit between the ejector means and the branch circuit inlet.

7. Heat transfer means comprising circuitry defining a closed flow path for circulating working fluid; a primary circuit forming part of said path and having two ends at one of which the working fluid is at a high pressure and at the other of which the working fluid is at a low pressure; a working fluid supply reservoir and a working fluid collection reservoir disposed respectively at said two ends; ejector means in said primary circuit; a drive fluid inlet, an exhaust outlet and a suction inlet provided on said ejector means; a liquified working fluid flow path in said primary circuit and extending from lower end-portions of the reservoir to the drive fluid inlet of the ejector means; a further flow path extending from the exhaust outlet of the ejector means to means for cooling and liquifying vaporized working fluid flowing from the ejector means; a branch circuit bridging a section of the primary circuit; an outlet end of said branch circuit connected to the suction inlet of the ejector means and an inlet end of the branch circuit connected to receive liquified working fluid from said liquified working fluid flow path of the primary circuit; an expansion valve in said branch circuit and an evaporative heat-exchanger connected for flow therethrough of working fluid flowing from the expansion valve towards the suction inlet; heating means associated with the reservoirs and operable to raise the temperature of liquified working fluid in the fluid supply reservoir; and, valve means to interchange, periodically, the functions of the two reservoirs when the fluid supply reservoir is full and the fluid collection reservoir is empty.

8. Heat transfer means as set forth in claim 7, in which said liquified working fluid flow path is connected in parallel with the branch circuit.

9. Heat transfer means as set forth in claim 8, having a cooler connected in the primary circuit between the reservoir and the branch circuit.

10. Heat transfer means as set forth in claim 9, having a second heat exchanger providing two mutually isolated flow passages in heat exchange relationship, one of said passages forming part of a flow path extending between said cooler and said expansion valve, and the second of said passages forming part of a flow path extending between the evaporative heat exchanger and the suction inlet of the ejector means.

11. Heat transfer means as set forth in claim 10, forming part of an air-conditioning unit having a means for circulating air past said evaporative heat exchanger, and including reversing valve means controlling the path taken by the working fluid in the branch circuit and which is selectively operable between two positions to provide heating and cooling of the air stream respectively.

* * * * *